United States Patent [19]

Gerretz et al.

[11] Patent Number: 4,890,470

[45] Date of Patent: Jan. 2, 1990

[54] LOOP TRANSPORT SYSTEM FOR A PLURALITY OF BASKETS CONTAINING MATERIAL TO BE DRAWN THROUGH A DRAWING MACHINE

[75] Inventors: Josef Gerretz, Viersen; Ewald Henn, Mönchengladbach, both of Fed. Rep. of Germany

[73] Assignee: Mannesmann Aktiengesellschaft, Desseldorf, Fed. Rep. of Germany

[21] Appl. No.: 225,683

[22] Filed: Jul. 28, 1988

[30] Foreign Application Priority Data

Jul. 29, 1987 [DE] Fed. Rep. of Germany ..... 3725511

[51] Int. Cl.[4] ..... B21C 1/32

[52] U.S. Cl. ..... 72/289; 72/420; 72/287

[58] Field of Search ..... 72/287, 289, 280, 274, 72/420; 242/79

[56] References Cited

U.S. PATENT DOCUMENTS 618,396 1/1899 Cowles ..... 72/287
2,885,060 5/1959 Dobosy ..... 72/287
3,536,274 10/1970 Tommarello et al. ..... 72/287
3,827,274 8/1974 Schuetz ..... 72/289

FOREIGN PATENT DOCUMENTS 1158027 11/1963 Fed. Rep. of Germany ..... 72/287

*Primary Examiner*—Daniel C. Crane
*Attorney, Agent, or Firm*—Nils H. Ljungman

[57] ABSTRACT

A loop transport system for baskets containing looped rod material to be drawn in a drawing machine is provided. Such system includes a conveyor arranged in a substantially closed loop. The conveyor supports and guides a plurality of baskets containing the material to be drawn sequentially to a feeder station, a payoff station, a delivery station and a basket removal station. In these different stations the functions to be performed therein are executed simultaneously or at least partially at the same time. To significantly improve the effectiveness of such a transport system and to reduce the drawing time, due to the inevitable tears in the looped rod material, the invention provides in the area between the payoff station and the delivery station a basket handling branch for the introduction and extraction of baskets containing the looped rod material to be drawn.

11 Claims, 4 Drawing Sheets

LOOP TRANSPORT SYSTEM FOR A PLURALITY OF BASKETS CONTAINING MATERIAL TO BE DRAWN THROUGH A DRAWING MACHINE

BACKGROUND OF THE INVENTION

1. Field of the Invention:

The present invention relates, in general, to a loop transport system for baskets containing looped rod material to be drawn through a drawing machine and, more particularly, this invention relates to a transport system laid out in a substantially endless loop to which a predetermined plurality of baskets containing such looped rod material to be drawn can be fed in sequence to each of a feeder station, a payoff station, a delivery station and a basket removal station in a manner such that the functions performed in each of the individual stations can be conducted in a staggered and/or at least a partially simultaneous fashion. The present invention, also, encompasses a method of minimizing lost production in a substantially closed loop transport system of the type described above.

2. Description of the Prior Art:

Prior to the present invention a number of transport systems for baskets containing looped rod material to be drawn have been taught in the prior art. Further a number of these systems are in commercial use in industry. Generally these transport systems for such baskets containing the material to be drawn are components of the drawing block units. In order to provide economy of operation in drawing of rods, it is common practice to provide a plurality of baskets and basket stations for the execution of the work sequence. It is necessary, generally in chronological order, to first introduce a basket into the loop system. After such basket has been introduced into the loop system, one end of the looped rod material is prepared for a pointing operation. The prepared end of the looped rod material is then pointed and the basket is sent to a payoff station positioned ahead of the drawing die. The looped rod material is fed through the drawing unit and discharged into a basket positioned at a delivery station beneath the drawing block. Thereafter the basket containing the finished drawn looped rod material is either fed to a second drawing process for a further reduction in cross-sectioned size or the basket may be removed from the transport loop system.

It has been found, through experience of operation, that the economical utilization of the drawing machine equipment becomes possible only when the above-mentioned functions performed in each of the individual stations can be performed at least in a partially simultaneous manner. It has also been found that the upper limit for the number of stations as well as the number of baskets containing the looped rod material to be drawn ranges between seven to nine.

In one prior art transport system arrangement, a so-called forced loop system is used. In such a forced loop system, all of the baskets pass through the various stations provided in a loop by means of cars. Such cars are connected to one another by chains, cables, etc.

The prior art also includes unconnected loop system arrangements. In such unconnected loop systems, all of the baskets containing the looped rod material to be drawn pass through each of the various stations individually. For example, they are transported on a roller train or conveyor. Regardless of which transport system is used, depending on the final sizes to be produced in the drawing operation, all of the baskets containing the looped rod material to be drawn in such loop transport system will pass through each of the individual stations at least once and possibly a plurality of times.

Furthermore, in spite of how carefully the drawing program is laid out, with respect to the reduction of the number of individual trains required, a problem persists when the looped rod material being drawn becomes torn apart repeatedly. When a tear in the looped rod material occurs, after a portion of a coil has already been proceeded through the die member of the drawing apparatus and has been discharged into the delivery basket positioned beneath the drawing block, the conventional prior art practice is to shut the system down. After the system has been shut down the basket containing the remaining portion of the looped rod material is run back to the pointing station to have a point prepared on the end of the remaining looped rod material. Thereafter, the system is switched to forward so that the remainder of the looped rod material can be drawn and deposited in the basket containing the other portion of such drawn looped rod material.

The delay encountered by such a tear in the looped rod material continues during the subsequent drawings, down to the final product size, and can significantly lengthen the overall drawing time. Clearly, there is an increased cost associated with the drawing as well.

OBJECTS OF THE INVENTION

It is, therefore, one of the primary objects of the present invention to provide a looped rod transporting system for moving in a predetermined sequential manner, a plurality of baskets which contain therein a looped rod material to be drawn in a wire drawing machine which substantially minimizes the problems associated with a tear in such looped rod material, as it is undergoing drawing.

Another object of the present invention is to provide a looped rod transporting system for moving in a predetermined sequential manner a plurality of baskets containing looped rod material to be drawn in a wire drawing machine which provides enhanced production capability through such wire drawing machine.

Still another object of the present invention is to provide a looped rod transporting system for moving in a predetermined sequential manner a plurality of baskets containing looped rod material to be drawn in a wire drawing machine which significantly lowers the operating cost of the wire drawing equipment.

Yet another object of the present invention is to provide a process of operating the loop transport system associated with a wire drawing machine which minimizes lost production.

SUMMARY OF THE INVENTION

In one embodiment of the invention, the branch is a conveyor segment which can rotate around a vertical axis and is inserted into the conveyor path between the payoff and the delivery station. By means of such a conveyor segment, the transport direction of the basket containing material to be drawn placed on the conveyor segment can be changed, and the conveyor segment can be optionally temporarily connected with conveyors for the removal and introduction of the baskets containing material to be drawn.

Considering the fact that between the payoff station and the delivery station, the bending direction of the tube is changed from unwinding to winding, these two stations as a rule are located ahead of and behind a bend in the conveyor system. The invention makes use of this layout, in that another characteristic of the invention is that the conveyor segment is located in the corner of the conveyor segments which approach one another at an angle.

By means of the proposed loop transport system, the removal and introduction of baskets containing material to be drawn can be carried out after a rod tear.

In summing up, one aspect of the invention resides broadly in a looped rod transporting system for moving in a predetermined sequential manner a plurality of baskets which contain therein looped rod material to be drawn through a die member of a wire drawing machine, the looped rod transporting system comprising:

(a) a feeder station in which a forward end of the looped rod material contained in one of the plurality of baskets is prepared for introduction into the die member of the wire drawing machine;

(b) a looped rod payoff station from which the looped rod material to be drawn is fed through the die member and then wound around a drawing block of the wire drawing machine a predetermined number of wraps;

(c) a looped rod delivery station in which the looped rod material is deposited in one of the plurality of baskets positioned substantially adjacent to the drawing block after having passed through the die member of the wire drawing machine:

(d) a basket removal station from which a basket containing drawn looped rod material deposited therein at the delivery station can be removed;

(e) a substantially closed loop conveying mechanism for sequentially conveying and guiding each of the plurality of baskets containing the looped rod material to the feeder station, the looped rod payoff station, the looped rod delivery station and the basket removal station so that functions performed in each individual station can take place in at least one of a simultaneous and a partially simultaneous fashion; and (f) a basket handling arrangement having at least a portion thereof positioned intermediate the looped rod payoff station and the looped rod delivery station for directing one of the plurality of baskets containing the looped rod material in a predetermined direction so that it can be at least one of removed from and introduced into the looped rod transporting system.

Another aspect of the invention resides broadly in a method of minimizing lost production in a substantially closed loop transport system used to transport a plurality of baskets containing looped rod material to a wire drawing machine when a disruption occurs in a drawing process on the looped rod material before a basket containing it has been emptied, the substantially closed loop transport system including a feeder station, a looped rod payoff station, a looped rod delivery station, a basket removal station, a substantially closed loop conveying mechanism and a basket handling arrangement, the method comprising the steps of:

(a) removing a basket containing a remaining portion of the looped rod material to be drawn from the payoff station:

(b) removing a partially filled basket of drawn looped rod material from the delivery station;

(c) advancing forward by one cycle all of the plurality of baskets containing the looped rod material remaining on the substantially closed loop transport system;

(d) introducing an empty basket to the delivery station to receive drawn looped rod material therein;

(e) determining an amount of looped rod material remaining in the basket removed in step (a); and (f) returning the basket removed in step (a) to a suitable location of the substantially closed loop transport system ahead of the feeder station when the amount of looped rod material remaining in the basket as determined in step (e) is sufficiently large enough.

In addition to the above described obJects and advantages of this invention, various other objects and advantages of the loop transport system will become more readily apparent to those persons who are skilled in the wire drawing art from the following more detailed description of the invention when such description is taken in conjunction with the attached drawings.

DESCRIPTION OF THE PREFERRED EMBODIMENTS

Figure 1:
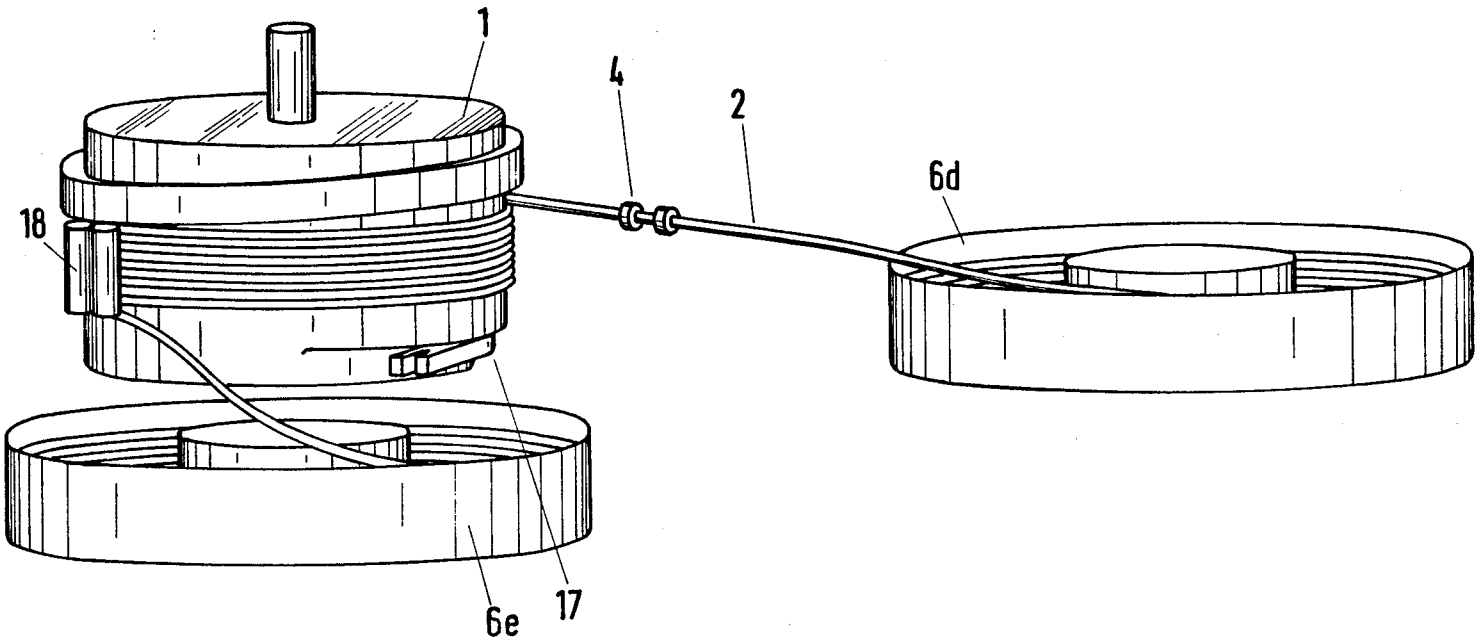
FIG. 1 is a prospective view which illustrates a general layout of a drawing block apparatus with certain parts eliminated for clarity.

Prior to proceeding to the detailed description, it should be understood that as used in the specification and claims, the term rod material includes rods, wire and tubular material.

Further, it should be noted that, throughout the several views of the drawings, identical components of the invention have been identified with identical reference numerals.

Now refer more particularly to FIG. 1. Illustrated therein is a drawing block 1 having a plurality of wraps of the looped rod material 2 wound around it. The looped rod material 2 is supplied from a payoff basket 6*d* and is pulled through a die plate member 4 by the drawing block 1. The draw looped rod material 2 is discharged from the drawing block 1 into a delivery basket 6*e* positioned substantially beneath such drawing block 2. The details of this arrangement of the drawing apparatus are conventional and well known in the prior art. For this reason, additional details of the drawing apparatus will not be required for an understanding of the invention.

Figure 2:
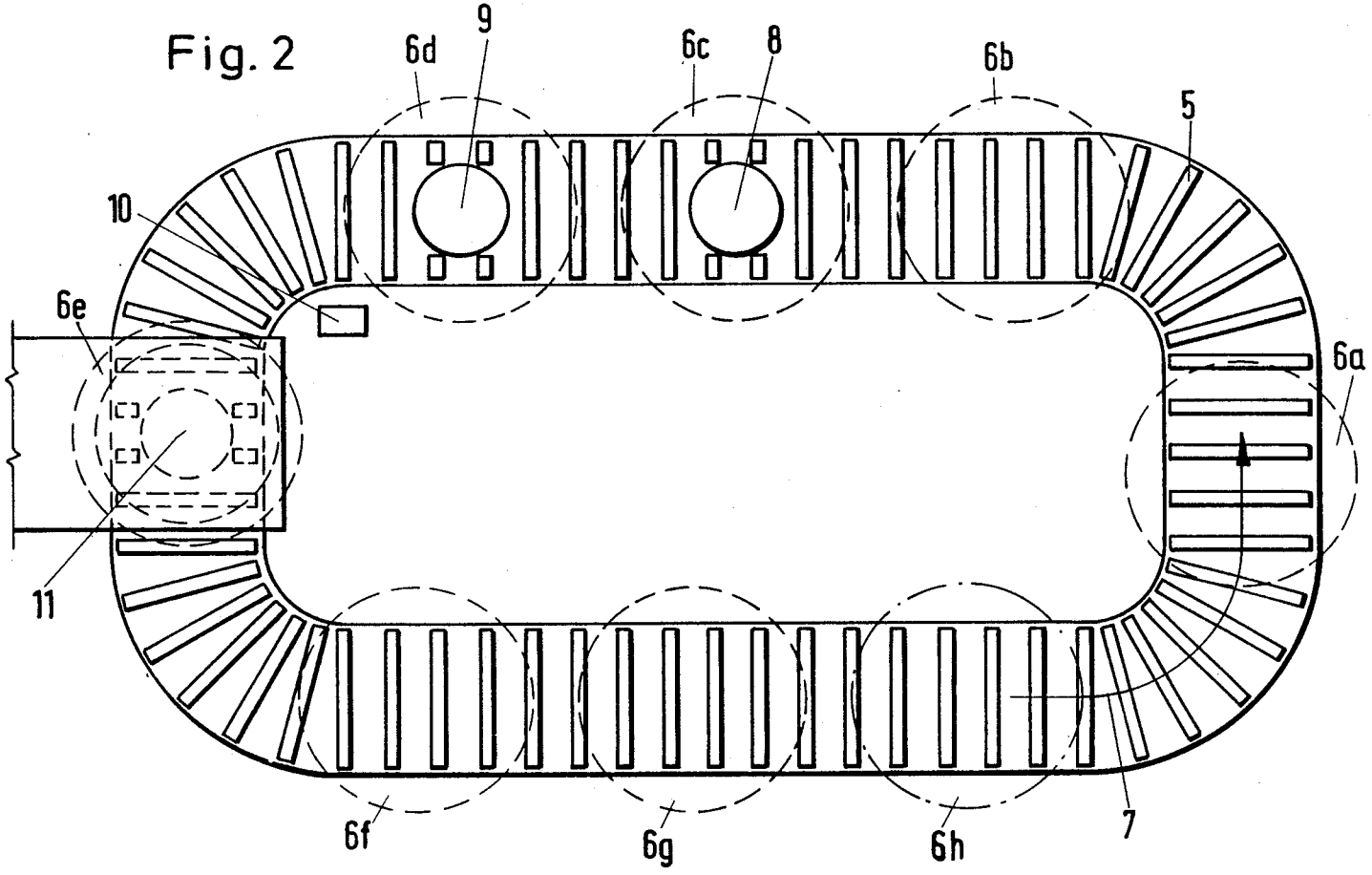
FIG. 2 is a plan view which illustrates one form of a loop transport system known in the prior art.

Now referring more particularly to FIG. 2, which illustrates one type of a conventional loop transport system of the prior art to which the present invention is particularly adapted. This conventional loop transport system operates in the following manner. In this embodiment there is shown eight baskets, indicated by dotted lines and designated as 6*a* through 6*h*, which contain looped rod material 2 to be drawn. These eight baskets 6*a* through 6*h* are positioned on the roller train on conveyor 5. This roller conveyor is laid out essentially as an endless loop. The eight baskets 6*a* through 6*h* are transported on the roller conveyor 5 in the direction indicated by the arrow 7. The basket 6*a* containing looped rod material 2 is placed on the roller conveyor 5 in the position illustrated. A fork lift, for example, may be used to place baskets containing looped rod material 2 onto the roller conveyor 5. As required, the basket 6*a* is further transported on the roller conveyor 5 by moving one cycle into the position in which another basket 6*b* containing looped rod material 2 is illustrated in the drawing. Simultaneously, as the basket 6*a* is being transported forward by one cycle, the basket 6*b* containing looped rod material 2 to be drawn and all of the other baskets on the roller conveyor 5 are being transported forward by one position. At this point in the process the basket 6*b* containing the looped rod material 2 will reach the pointing station 8. At the pointing station 8, the forward end of the looped rod material 2 to be drawn is prepared for introduction into the drawing unit. In FIG. 2, the basket 6*c* containing looped rod material 2 is shown in the position of the pointing station 8. When it has been transported forward by one additional cycle, the basket 6*b* contained looped rod material 2 to be drawn is brought into the position in which the basket 6*d* containing looped rod material 2 is illustrated in the drawing. The basket 6*d* containing the looped rod material 2 to be drawn is now in a payoff station 9. In the payoff station 9, the looped rod material 2 to be drawn is conducted through the die plate member 10 and wrapped around the drawing block 1 of the delivery station 11 a predetermined number of wraps. The delivery station 11 is located above the drawn material receiving basket 6*e* which, in the meantime, has been placed underneath the drawing block 1 after having been moved in cycles with the other baskets 6*a* through 6*d*. In this manner the basket 6*e*, containing drawn looped rod material and shown in the delivery station 11, is now advanced to the position of the basket 6*h* as shown in the drawing. After the completion of the drawing process, if necessary to achieve a final cross-sectional size, additional passes of the looped rod material 2 through the drawing apparatus may occur. Nevertheless, when the desired cross-sectional size is achieved the finished drawn looped rod material is removed from the system, for example, into a position in which the basket 6*h* containing looped rod material 2 is shown in the drawing.

In the case when a disruption in the drawing process would occur, in the system of the prior art illustrated in FIG. 2, the roller conveyor 5 had to be shut down. Such a disruption would occur, for example, when a break or tear would occur in the looped rod material being drawn at the time through the die plate member 10. In this situation the basket 6*d*, containing the remaining portion of the looped rod material 2 yet to be drawn, located in the payoff station 9 in FIG. 2, had to be returned to the pointing station 8 to reattach the torn tube or rod end. After the torn end had been reattached, the basket 6*d* then had to be brought back to the payoff station 9. At this point the drawing process on the looped rod material 2 can be started once more. The other torn end of the coiled looped rod remained in the basket 6*e*, containing the drawn portion of the looped rod material positioned at the delivery station 11. The newly-pointed and drawn looped rod material 2 from the payoff station 9 was discharged into the same basket 6*e* containing previously drawn looped rod material 2, because, in the meantime, no empty basket could be introduced into the delivery station 11. It should be obvious that considerable production is lost when a break occurs in the looped rod material 2. Furthermore, the more breaks which occur the greater the production loss.

Figure 3:
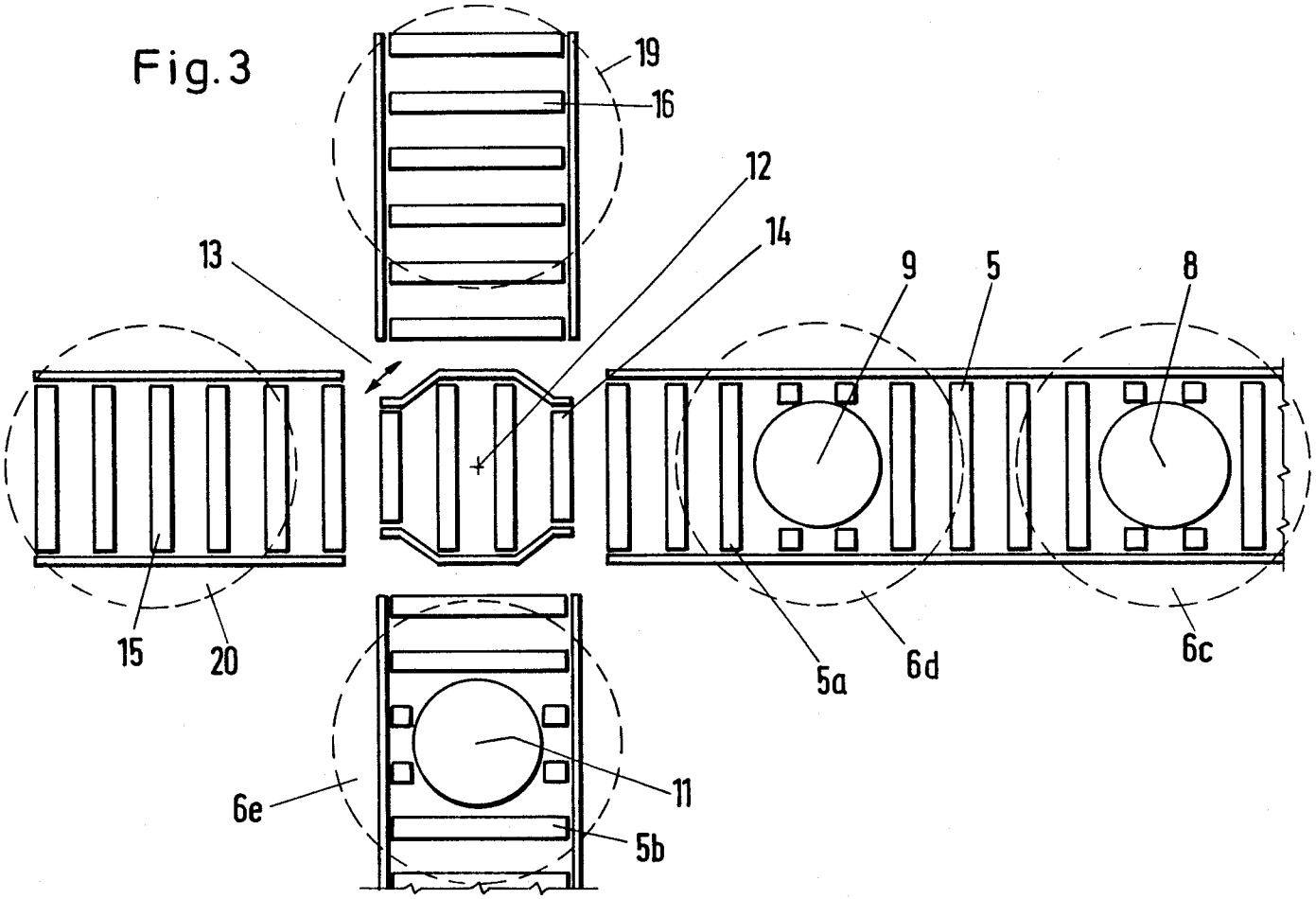
FIG. 3 is a partially fragmented plan view which illustrates a portion of a prior art loop transport system having a presently preferred embodiment of a conveyor segment constructed according to the present invention in a first position.
Figure 4:
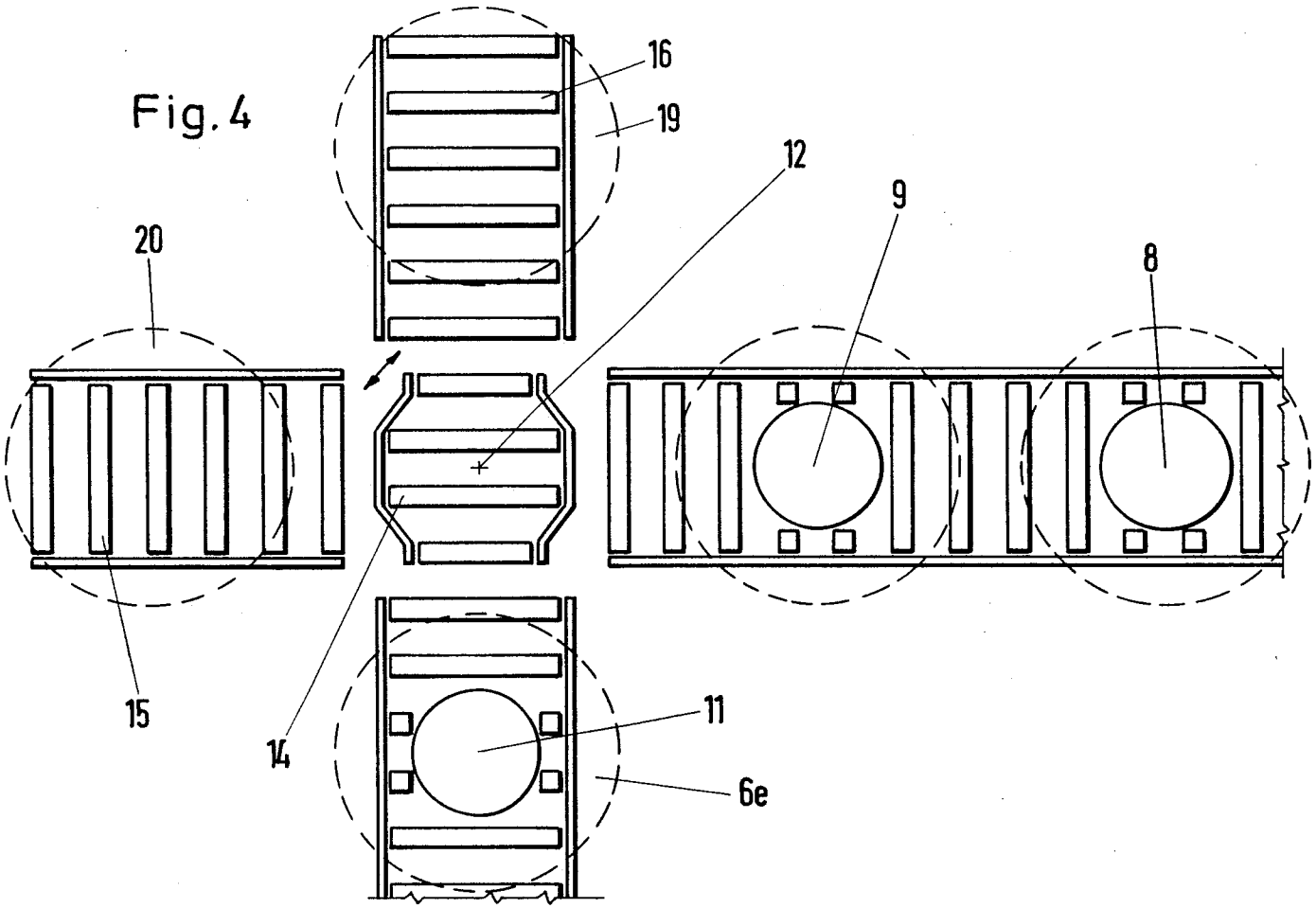
FIG. 4 is a partially fragmented plan view which illustrates the conveyor segment of the present invention in a second position.

Now refer more particularly to FIGS. 3 and 4 for a clear understanding of a presently preferred embodiment of the invention. In the corner area of the conveyor 5, preferably a roller conveyor, there is a basket handling means, preferably a conveyor segment 14 which is capable of rotating around a substantially vertical axis 12. Such conveyor segment 14 can rotate in both directions of the arrow 13 around such axis 12. The conveyor segment 14 interrupts both of the conveyor 5 branches 5*a* and 5*b*. Depending on the rotational position of the conveyor segment 14, such conveyor segment 14 can be temporarily connected to a conveyor section 15 or 16, which is intended for the introduction of an empty basket or the removal of a basket containing drawn looped rod material 2, respectively. In the presently preferred embodiment of the invention, conveyor sections 15 and 16 are roller conveyors of generally the same characteristics as the roller conveyor 5.

It should be noted that during normal operations, the overall cycle time of the apparatus constructed, according to the present invention, is comparable to the cycle time of the prior art apparatus. As the description proceeds, however, it will become clear that the cycle time of the apparatus constructed according to this invention will be considerably shortened when a disruption occurs in the process over that of the prior art apparatus undergoing the same disruption.

After the basket 6*c*, containing looped rod material 2 to be drawn, has been transported out of the pointing station 8 and into the payoff station 9, the pointed end of the looped rod material 2 is introduced through the die plate member 4 and is engaged by the drawing tongs 17 illustrated in FIG. 1.

A predetermined number of windings of the looped rod material 2 are wound around the drawing block 1. These windings are both positioned and held in place by means of the pressure rollers 18 as illustrated in FIG. 1 of the drawings. After trimming off the pointed end of the looped rod material 2, the drawing process can begin and continue to completion, unless a disruption should occur. As the respective baskets 6*a* through 6*e* are transported forward by one cycle, the full basket 6*e* containing drawn looped rod material 2 travels one step forward, and the basket 6*d* emptied of looped rod material 2 in the payoff station 9 is transported into the delivery station 11 beneath the drawing block 1. The time elapsed before completion of the shearing of the pointed end of the looped rod material 2 in preparation for the subsequent drawing process is usually sufficient to move the empty basket to the delivery station 11. This occurs without any interference with the normal cycle sequence. For this purpose, the basket 6*d* which has been emptied of the looped rod material 2 in the payoff station 9 is transported forward onto the conveyor segment 14. At this point the conveyor segment 14 is rotated by about 90 degrees. Thereafter, the empty basket can be filled with a drawn looped rod material 2 in the delivery station 11 located under the drawing block 1 of the drawing apparatus.

For the situation when a break or tear occurs in the looped rod material 2 being drawn, the invention makes the enhanced method of operation which will now be described in detail possible.

The basket 6*d* located in the payoff station 9 which contains therein the remaining portion of the looped rod material 2 to be drawn is in the position illustrated in FIG. 3. Such basket 6*d* is directly and immediately removed from circulation in the system onto the roller conveyor 15. At this point the roller conveyor segment 14 is rotated by about 90 degrees into the position illustrated in FIG. 4. In this position, an empty basket to receive drawn looped rod material therein can be transported from the roller conveyor 16 directly into the delivery station 11 under the drawing block 1. The partially filled basket containing same drawn looped rod material 2 therein previously located at the delivery station 11 was transported forward by one cycle with each of the other baskets supported on the substantially closed loop conveyor 5.

In this particular scheme, the basket, which is designated 20 in FIG. 3, containing looped rod material 2 to be drawn after removal from the circuit can be returned once again to the production input station. This can be accomplished independently of the working cycle, for example, by means of a fork lift, without any substantial adverse impact on the cycle sequence which would be caused by reversing the conveyor 5 as is conventional prior art practice. The basket 20 corresponds to basket 6*d* which contains looped rod material 2 to be drawn.

It can be seen from the above-description that the loop transport system for a drawing operation and the process for operating such system, according to the present invention, significantly increases the efficiency of the drawing process and reduces the drawing time required, especially considering the inevitable breaks or tears that occur in the looped rod material to be drawn. To achieve these advantages the present invention takes advantage of the fact that the roller conveyor 5, in the area between the payoff station 9 and the delivery station 11, has a branch for the removal and introduction of baskets which either contain looped rod material that has been drawn or are empty. According to the presently preferred embodiment of the invention, therefore, if a break or tear in the looped rod material 2 being drawn, the basket with the remaining portion of such looped rod material 2 that has already been drawn is removed from the circuit of the drawing apparatus between the payoff station 9 and the delivery station 11. Removal of this basket occurs without having to reverse the transport direction of the loop transport system. In place of the basket that has been removed, an empty basket to receive the looped rod material 2 therein after it has been drawn is preferably introduced at the same point in the circuit. At the same time the partially filled basket containing the previously drawn looped rod material 2 is transported forward from the delivery station 11.

As discussed above, in one presently preferred configuration of the invention, the basket handling means is a roller conveyor segment 14 which is capable of rotating around a substantially vertical axis 12. Such rotation may be about 90 degrees in two directions or up to 360 degrees if desired. Such roller conveyor segment 14 is inserted into the path of the substantially closed loop roller conveyor 5 between the payoff station 9 and the delivery station 11. By provision of this roller conveyor segment 14, in the present invention, the transport direction of a basket containing looped rod material 2 that is positioned thereon can be easily and quickly changed as required by the circumstances of the operation. It can be seen, for example, that the roller conveyor segment 14 can be optionally connected in a temporary manner with roller conveyors 15 and 16 for both removal and introduction of baskets either containing looped rod material 2 or empty.

Considering the fact that, in a drawing apparatus arrangement, between the payoff station 9 and the delivery station 11, the bending direction of the looped rod material 2 is changed from an unwinding direction to a winding direction, these two particular stations are, as a general rule, located ahead of and behind a bend in the substantially closed loop roller conveyor 5. The present invention makes particular use of this arrangement, in that another important characteristic of the invention is that the roller conveyor segment 14 is located in the corner of the roller conveyor segments 5*a* and 5*b* which approach one another at an angle. Preferably this angle is a right angle.

It is evident from the above description of the present invention that the improved loop transport system for a drawing installation and the method of operating such loop transport system provide an effective way of removing baskets partially filled with drawn looped rod material and introducing empty baskets into the installation when a break occurs in the looped rod material presently undergoing a drawing operation through a die plate member.

The invention as described hereinabove in the context of the preferred embodiments is not to be taken as limited to all of the provided details thereof, since modifications and variations thereof may be made without departing from the spirit and scope of the invention.

What is claimed is:

1. A looped rod transporting system for moving in a predetermined sequential manner a plurality of baskets which contain therein looped rod material to be drawn through a die member of a wire drawing machine, said looped rod transporting system comprising:

(a) a feeder station in which a forward end of said looped rod material contained in one of said plurality of baskets is prepared for introduction into said die member of said wire drawing machine;

(b) a looped rod payoff station from which said looped rod material to be drawn is fed through said die member and then wound around a drawing block of said wire drawing machine a predetermined number of wraps;

(c) a looped rod delivery station in which said looped rod material is deposited in one of said plurality of baskets positioned substantially adjacent to said drawing block after having passed through said die member of said wire drawing machine;

(d) a basket removal station from which a basket containing drawn looped rod material deposited therein at said delivery station can be removed;

(e) a substantially closed looped conveying mechanism for sequentially conveying and guiding each of said plurality of baskets containing said looped rod material to said feeder station, said looped rod payoff station, said looped rod delivery station and said basket removal station so that functions performed in each individual station can take place in at least one of a simultaneous and a partially simultaneous fashion; and (f) a basket handling conveyor intersecting said looped rod transporting system generally laterally of said substantially closed loop conveying machine and having at least a portion thereof positioned intermediate said looped rod payoff station and said looped rod delivery station for directing one of said plurality of baskets containing said looped rod material in a predetermined direction so that it can be at least removed from and introduced into said looped rod transporting system.

2. A looped rod transporting system for moving in a predetermined sequential manner a plurality of baskets which contain therein looped rod material to be drawn through a die member of a wire drawing machine, said looped rod transporting system comprising:

a feeder station in which a forward end of said looped rod material contained in one of said plurality of baskets is prepared for introduction into said die member of said wire drawing machine;

a looped rod payoff station from which said looped rod material to be drawn is fed through said die member and then wound around a drawing block of said wire drawing machine a predetermined number of wraps;

a looped rod delivery station in which said looped rod material is deposited in one of said plurality of baskets positioned substantially adjacent to said drawing block after having passed through said die member of said wire drawing machine;

a basket removal station from which a basket containing drawn looped rod material deposited therein at said delivery station can be removed;

a substantially closed loop conveying mechanism for sequentially conveying and guiding each of said plurality of baskets containing said looped rod material to said feeder station, said looped rod payoff station, said looped rod delivery station and said basket removal station so that functions performed in each individual station can take place in at least one of a simultaneous and a partially simultaneous fashion; and a basket handling means having at least a portion thereof positioned intermediate said looped rod payoff station and said looped rod delivery station for direction one of said plurality of baskets containing said looped rod material in a predetermined direction so that it can be at least one of removed from and introduced into said looped rod transporting system;

wherein said basket handling means includes:

(a) a rotatable conveyor segment positioned intermediate said looped rod payoff station and said looped rod delivery station, said rotatable conveyor segment being rotatable around a vertical axis, said rotatable conveyor segment providing said looped rod transport system a capability of changing a transport direction of a particular basket containing said looped rod material when said particular basket is positioned on said rotatable conveyor segment; and (b) at least one conveyor length positioned adjacent and substantially perpendicular to one side of said rotatable conveyor segment to temporarily receive said particular basket when a break occurs in said looped rod material to minimize downtime of said wire drawing machine.

3. The looped rod transporting system, as recited in claim 2, wherein said basket handling means includes:

(a) a first conveyor length positioned adjacent and substantially perpendicular to one side of said rotatable conveyor segment to temporarily receive said particular basket when a break occurs in said looped rod material; and (b) a second conveyor length positioned adjacent one side of said rotatable conveyor segment and substantially perpendicular to said first conveyor length to introduce an empty basket to said rotatable conveyor segment to receive a remaining portion of looped rod material contained in a basket at said looped rod delivery station.

4. The looped rod transporting system, as recited in claim 1, wherein said substantially closed loop conveying mechanism includes at least two conveying segments which approach one another at substantially a right angle and said basket handling means is located in a corner of said substantially closed loop conveying mechanism adjacent a respective end of each of said at least two conveying segments.

5. The looped rod transporting system, as recited in claim 1, wherein said substantially closed loop conveying mechanism is a roller conveyor.

6. The looped rod transporting system, as recited in claim 1, wherein said at least a portion of said basket handling means includes at least two rollers.

7. The looped rod transporting system, as recited in claim 3, wherein said rotatable conveyor segment includes at least two rollers and each of said first conveyor length and said second conveyor length and said substantially closed loop conveying mechanism is a roller conveyor.

8. The looped rod transporting system, as recited in claim 2, wherein said rotatable conveyor segment is capable of rotating over an angle of at least about 90 degrees.

9. The looped rod transporting system, as recited in claim 2, wherein said rotatable conveyor segment is capable of rotating 360 degrees.

10. The looped rod transporting system, as recited in claim 1, wherein said feeder station includes a means for pointing a forward end of said looped rod material.

11. The looped rod transporting system, as recited in claim 1, wherein said substantially closed loop conveying mechanism has an overall length sufficient to simultaneously support between about seven to about nine baskets containing said looped rod material.

* * * * *